US012203714B2

(12) United States Patent
Brooks

(10) Patent No.: US 12,203,714 B2
(45) Date of Patent: Jan. 21, 2025

(54) ELECTRICAL VELOCITY ENHANCEMENT ASSEMBLY

(71) Applicant: Eddie L Brooks, Tylertown, MS (US)

(72) Inventor: Eddie L Brooks, Tylertown, MS (US)

( * ) Notice: Subject to any disclaimer, the term of this patent is extended or adjusted under 35 U.S.C. 154(b) by 0 days.

(21) Appl. No.: 18/180,823

(22) Filed: Mar. 8, 2023

(65) Prior Publication Data

US 2023/0288154 A1 Sep. 14, 2023

Related U.S. Application Data

(60) Provisional application No. 63/317,862, filed on Mar. 8, 2022.

(51) Int. Cl.
*F41A 1/02* (2006.01)
*F41A 21/28* (2006.01)

(52) U.S. Cl.
CPC ..... *F41A 1/02* (2013.01); *F41A 21/28* (2013.01)

(58) Field of Classification Search
CPC .. F41A 1/02; F41A 13/04; F41A 13/06; F41A 13/08; F41A 21/28
See application file for complete search history.

(56) References Cited

U.S. PATENT DOCUMENTS 783,050 A * 2/1905 Knapp et al. ..... F41A 13/04 89/14.1
790,664 A * 5/1905 Smith ..... F41A 13/04 89/14.05
1,128,639 A * 2/1915 Tuskalas et al. ..... F41A 13/04 89/1.2
2,129,875 A * 9/1938 Helge ..... F41A 13/00 102/702
2,648,257 A * 8/1953 Stanley ..... F41A 1/02 89/8
2,922,341 A * 1/1960 Treat, Jr. ..... F41A 1/04 102/470
2,981,153 A * 4/1961 Wilson, Jr. ..... F41A 1/04 89/7
2,986,072 A * 5/1961 Hudson ..... F42B 5/16 89/7
3,138,990 A * 6/1964 Jukes ..... F41A 1/04 89/7
3,313,208 A * 4/1967 Dorsey, Jr. ..... F41A 1/04 102/431
3,459,101 A * 8/1969 Scanlon, Jr. ..... F41F 3/00 89/8
3,501,998 A * 3/1970 Dardick ..... F41A 9/46 89/157

(Continued)

*Primary Examiner* — Derrick R Morgan
(74) *Attorney, Agent, or Firm* — Law Office of Jeff Williams PLLC; J. Oliver Williams

(57) ABSTRACT

A firearm propulsion system for releasing a projectile from a firearm includes a firearm having a chamber, a barrel, and a firing pin with a primer. A supply port is passed through at least one of the barrel and the chamber so as to reach the interior. A control valve is in communication with the supply port and is configured to regulate the passage of pressurized gas into the at least one of the barrel and the chamber from the supply port. A sensor is included in the chamber and is configured to detect the location of the projectile passing through the chamber after firing the firearm. A control system communicates with the control valve and the sensor to selectively release pressurized gas into the chamber after firing.

8 Claims, 8 Drawing Sheets

(56) References Cited

U.S. PATENT DOCUMENTS 4,336,741 A * 6/1982 Baines ..... F41A 1/04 89/7
4,341,147 A * 7/1982 Mayer ..... F41A 1/04 89/7
4,376,406 A * 3/1983 Black ..... F41A 1/04 89/7
4,590,842 A * 5/1986 Goldstein ..... F41B 6/00 376/125
4,693,165 A * 9/1987 Magoon ..... F41A 1/04 89/7
4,895,062 A * 1/1990 Chryssomallis ..... F41B 6/00 102/440
4,930,394 A * 6/1990 Zwingel ..... F41B 6/00 89/7
4,934,242 A * 6/1990 Bulman ..... F41A 1/04 102/440
5,097,743 A * 3/1992 Hertzberg ..... F41A 1/02 89/7
5,131,313 A * 7/1992 Zimmerman ..... F41A 1/04 89/7
5,233,902 A * 8/1993 Bernardes ..... F41A 19/58 89/8
5,233,903 A * 8/1993 Saphier ..... F41B 6/00 89/7
5,381,722 A * 1/1995 Begneu ..... F41A 1/04 89/7
5,631,436 A * 5/1997 Brown ..... F41A 1/04 89/7
8,677,879 B1 * 3/2014 Gresham ..... F41A 13/04 42/106
10,415,925 B2 * 9/2019 Warren ..... F41B 11/64
11,724,824 B2 * 8/2023 Russell ..... B64C 30/00 244/171.3
2002/0083823 A1 * 7/2002 Gerber ..... F41A 13/04 89/1.25
2014/0260930 A1 * 9/2014 Russell ..... F41A 1/04 89/7
2016/0161212 A1 * 6/2016 Bergeron ..... F41A 1/04 124/71
2017/0030143 A1 * 2/2017 Russell ..... E21B 7/007
2017/0045322 A1 * 2/2017 Fiedorowicz ..... F41A 13/10
2022/0299282 A1 * 9/2022 Tasyagan ..... F41A 5/28
2023/0417499 A1 * 12/2023 Russell ..... F41A 21/28

* cited by examiner

ELECTRICAL VELOCITY ENHANCEMENT ASSEMBLY

CROSS REFERENCE TO RELATED APPLICATIONS

This application claims the benefit of an earlier filing date and right of priority to U.S. Provisional Application No. 63/317,862, filed 8 Mar. 2022, the contents of which is incorporated by reference herein in its entirety.

BACKGROUND OF THE INVENTION

1. Field of the Invention

The present application relates to guns and ammunition, and more particularly to an electrical method of increasing velocity of a projectile fired from a weapon.

2. Description of Related Art

Every projectile for artillery shell that is fired using a firing pin to contact a primer to explosive powder which rapidly increases the pressure within the chamber and propels the projectile forward down the barrel's length to the crown. Multiple choices within various designs, barrel length, types of powder, types of lands, barrel diameter, projectile diameter, and projectile profiles may affect the velocity of a projectile and the distance to which it can accurately travel. A single discharge of the powder only produces one propulsion force which quickly diminishes as the projectile travels through the barrel, to the point of impact. Although strides have been made, shortcomings remain. It is desired that a system be set up to increase the speed of the projectile through the introduction of a longer repressurization force or by/from supplemental repressurization force applied after firing but prior to the exiting of the projectile from the chamber.

BRIEF SUMMARY OF THE INVENTION

It is an object of the present application to provide a firearm with an electronically controlled supplementary propulsion system to assist in propelling a projectile after firing. The electronic velocity enhancement assembly includes one or more supply ports formed into the firearm that form a channel from an exterior to the interior of the chamber. Control valves are used to regulate the release of pressurized gas into the chamber. Sensors are used to detect the location of the projectile in the chamber to determine the precise time to release the pressurized gas.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
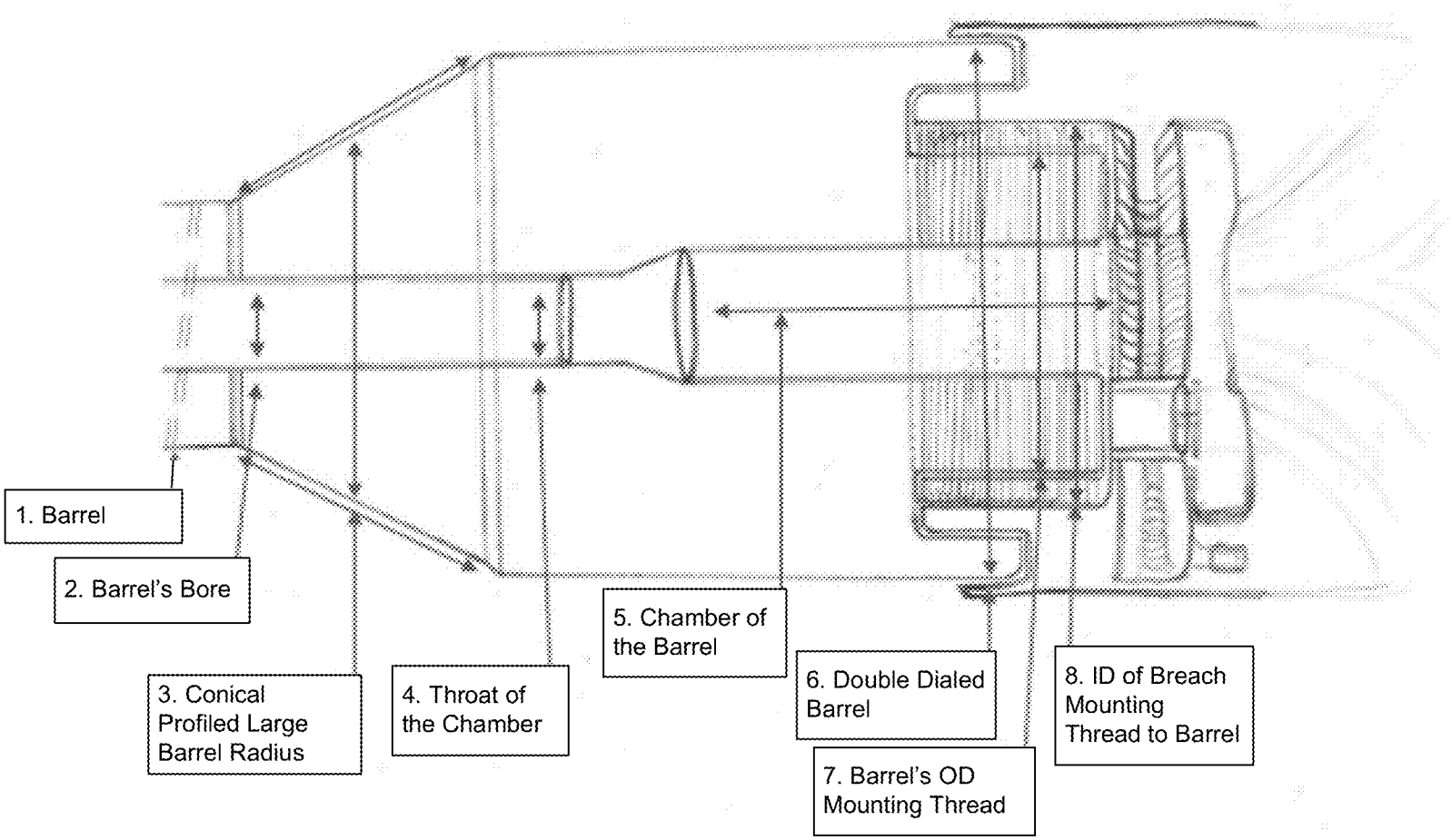
FIGS. 1-4 are side section views of a firearm with electrical artillery enhancement according to an embodiment of the present application.
Figure 2:
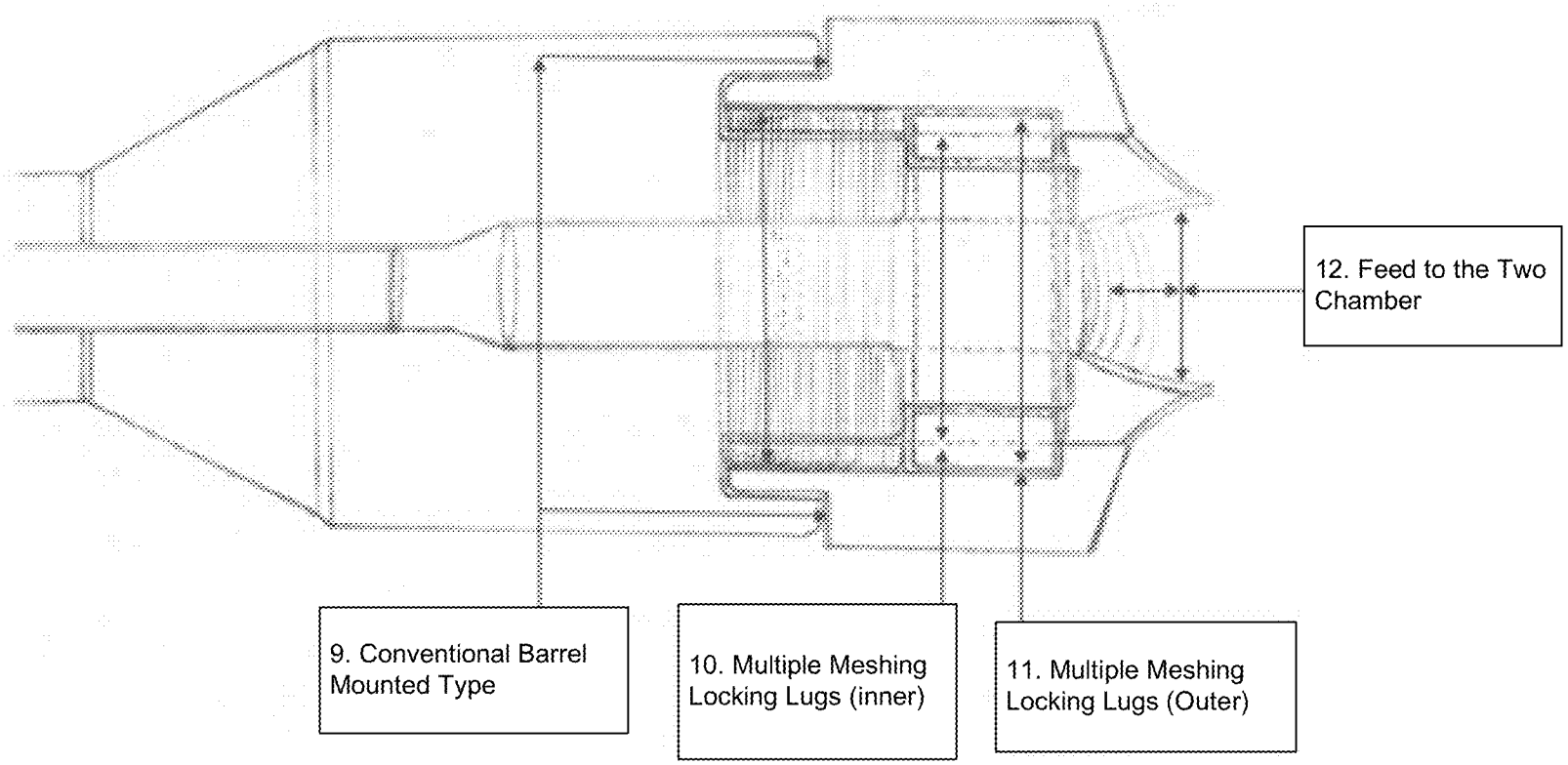
Figure 3:
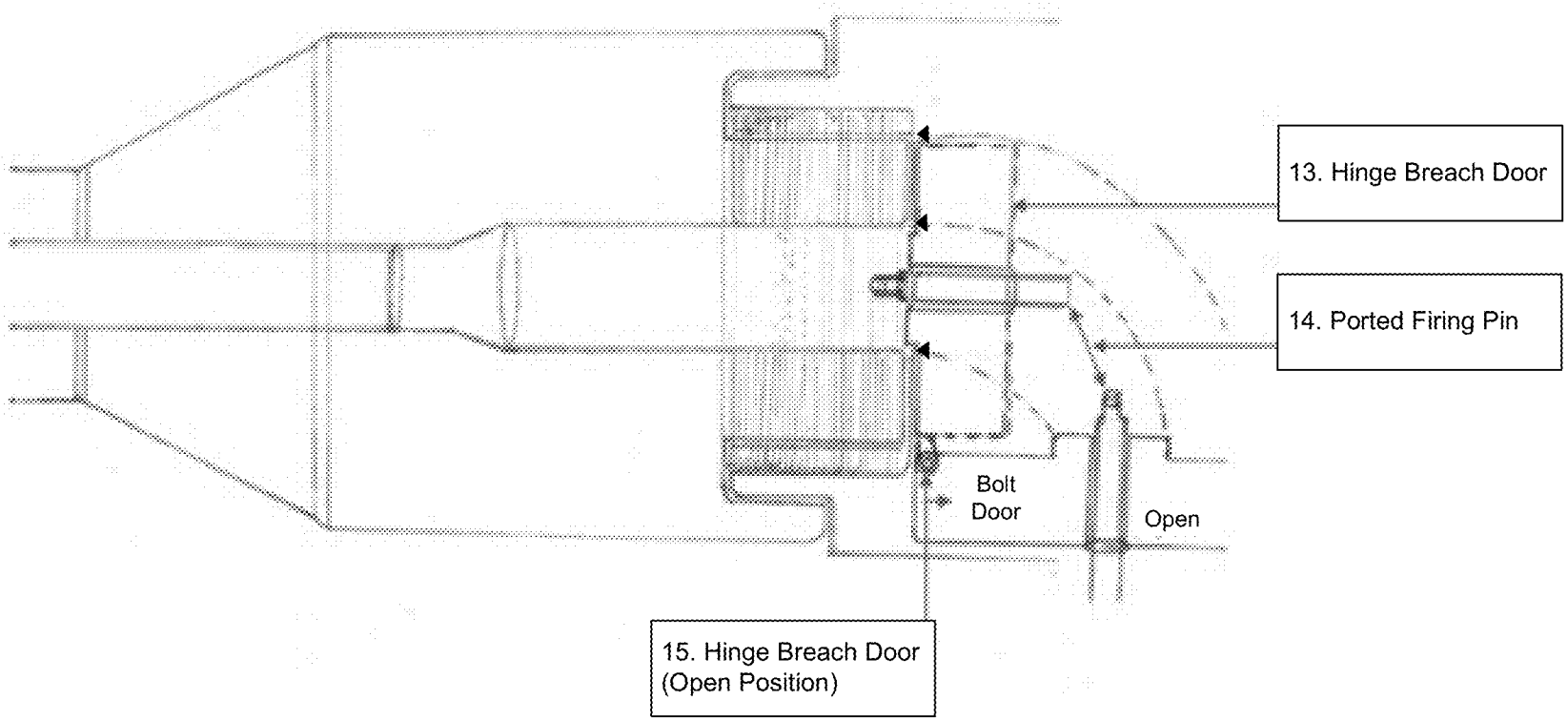
Figure 4:
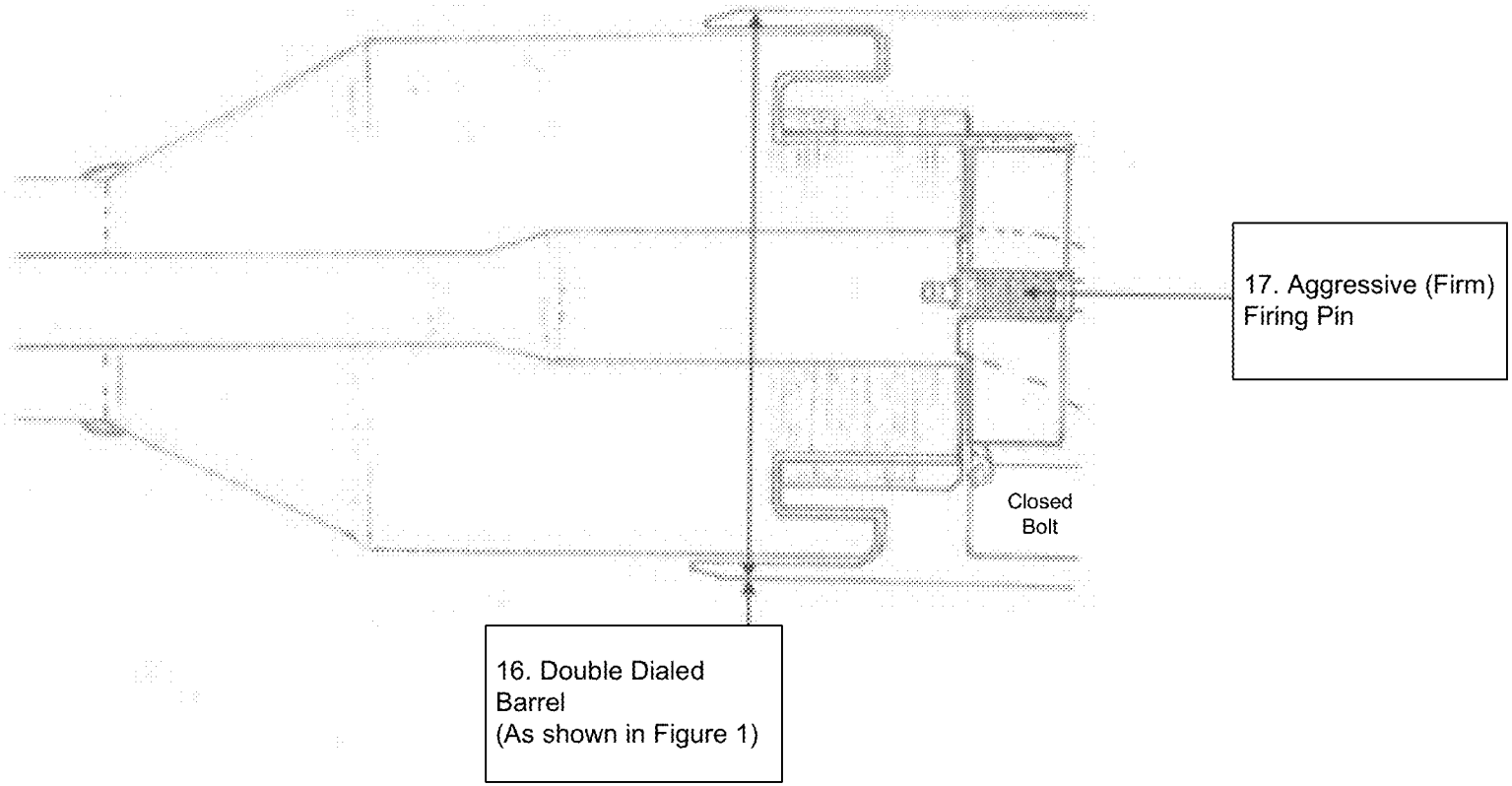

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

The electrical artillery enhancement of the present application is configured to induce a repressurization within the firearm chamber following the firing of ammunition. The secondary propulsive pressure repressurizes the chamber behind the movement of the projectile after the projectile leaves the throat, entering the lands of the barrel. This acts to increase the propulsive forces applied to the projectile which induces greater velocity to the projectile and helps to flatten the path of travel so as to increase the accuracy of the projectile.

This concept is best described as the technological and methodical controls of gas pressurizations, repressurizations, burn rate, the heat produced, and ambient conditions to create maximum versatility. In part this methodology includes at least a trio of calculations including a constant presence, producing/manufacturing firearms, and such like products this concept might be quickly comprehended and applied; for usage within small to large calibers conventional, and highly technical firearms, and similar devices, more importantly, the primary focus for this concept was and is to even better equip the United States of America or the American Department of Defense with these added values. The invention includes the monitoring and selective placement of one or more sensors within portions of the firearm to obtain the necessary data to time the pressured release of gas into the chamber.

This invention is focused on providing maximum ballistic versatility and all calibers of projectiles/bullets by and with the inclusion of cutting-edge technologies applied to methodology controls for C.U.P.s or barrel pressures from the chamber of the live rounds/projectiles to the crown or the end of the barrel. This thereby maximizes to minimizes gas pressurization as needed based on the task at hand. The concept might be applied within small to large caliber handguns and various shoulder guns developed for critical impact from short ranges to extreme shooting distances.

Species disclosed in the Figures act as an electrical repressurization of big-bore shoulder guns, etc. This species depicts numeric and verbal call-outs of virtually all elements and/or components needed to manufacture this product. We have produced the above-described draft as a modified electrical repressurization function within motions of manual conventional big-bore shoulder guns with an electrical assist in calibers from 7 mm caliber up to 8" artillery weapons.

Referring now to FIGS. 1-7 in the drawings, a set of side section views are illustrated of the invention. The Figures are focused on the firing mechanism and chamber of the firearm. Although shown with respect to a firearm it is understood to equally apply in principle of operation to larger projectiles that extend beyond handheld firearms. In operation, the chamber is ported downstream to the projectile prior to firing. The ports are pressurized (as seen more clearly in FIGS. 5-7) wherein a control valve is electronically controlled. Behind the valve, is pressurized gas. The valve acts to prevent expelling the pressure until it is optimal to do so. A plurality of sensors are in communication with the various parts of the firearm to capture data related to the firearm, ammunition, and even conditions within the firearm. The sensors are all configured to communicate with each other and are monitored through at least one electronic computational, processing and control assist device. Data may be stored and processed to thereby send command data to any number of valves or electronic devices within the system.

Figure 5:
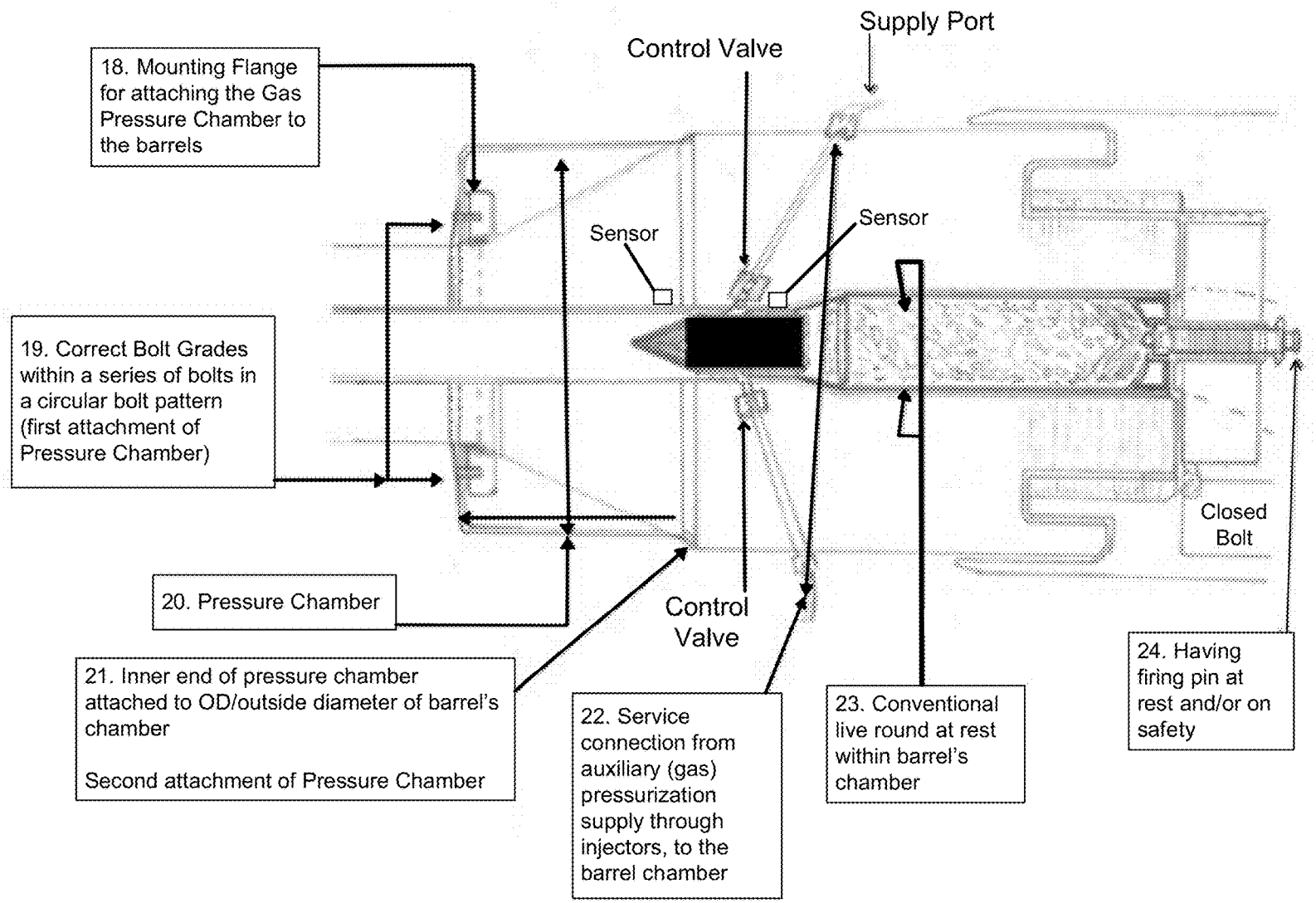
FIGS. 5-7 are side section views of the firearm of FIGS. 1-4 with ports, valves and sensors illustrating the firing process.
Figure 6:
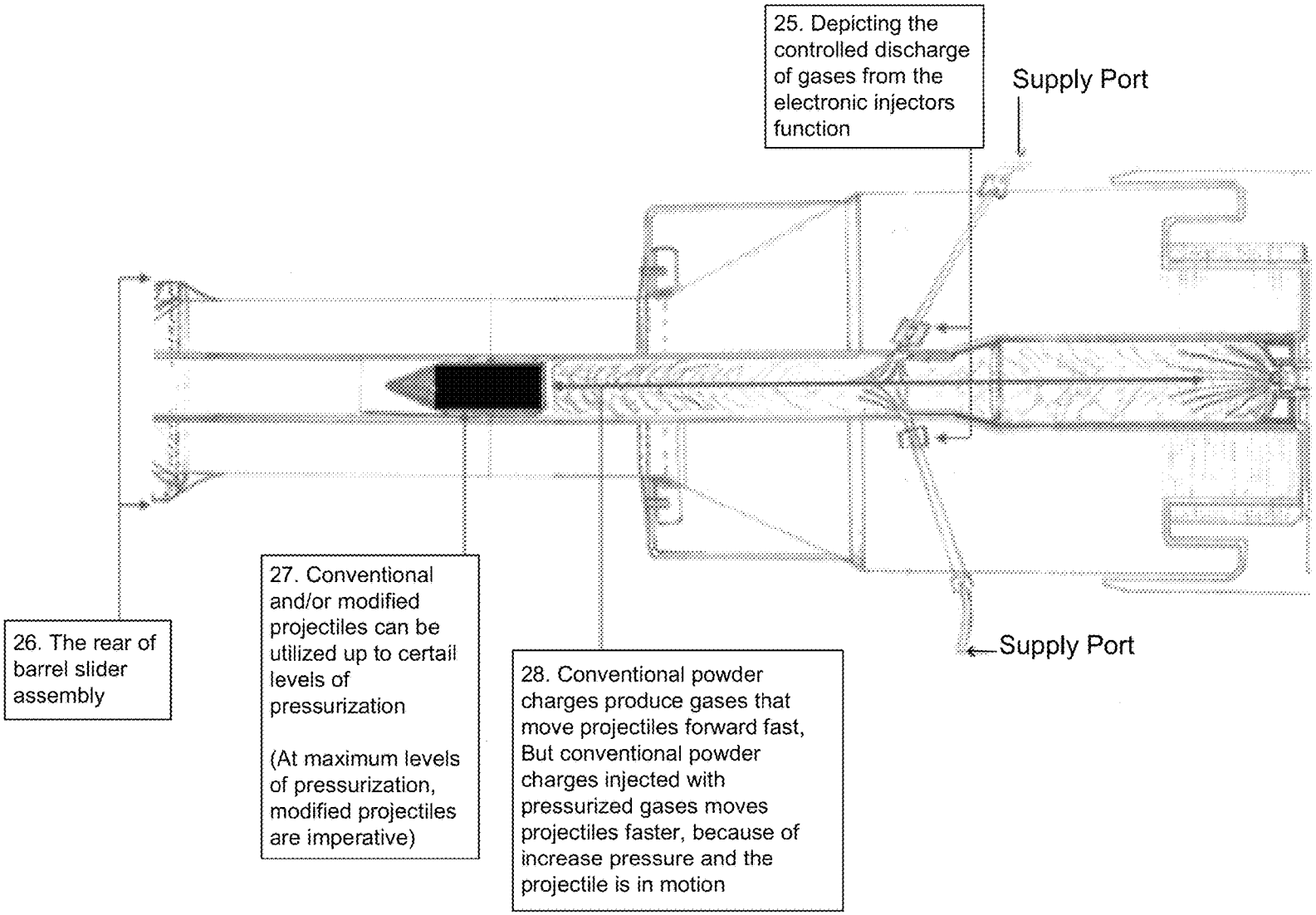
Figure 7:
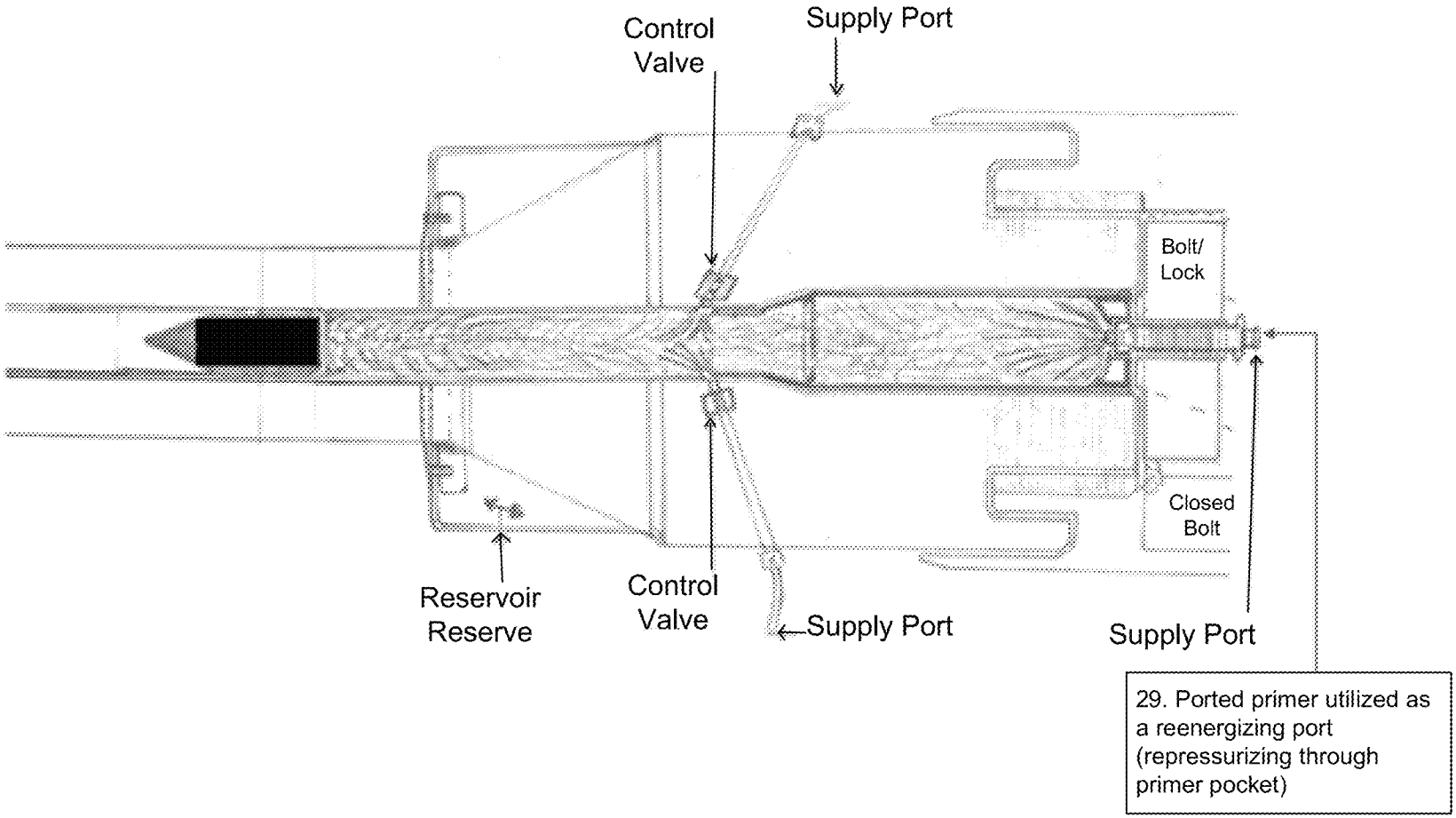

As seen in FIGS. 4-7 in particular, the firing of a projectile is illustrated in operation with the present invention. In FIG. 5, the projectile is just fired with the firing pin 24. The sensors are in communication with an internal surface of the chamber and are configured to detect the presence or passing of the projectile. The sensors may be located anywhere along the length of the chamber but are primarily suited to be near the supply ports so as to accurately determine the timing of the pressurized gas release through the control valves. FIGS. 6-7 show the effects of the pressurized gas in the chamber following the passing of the projectile. As seen in FIG. 7 in particular is that the primer 29 may be ported to facilitate repressurizing through the primer after firing. This allows the option of a dual stage infusion of pressurized gas into the chamber at/or after firing.

Upon firing of the projectile, the electronic device receives communication of the firing and calculates the precise time to open the valves. The valves connect the tubing of pressurized gas with the chamber of the firearm. As the projectile is propelled down the barrel, the ideal time to discharge additional pressure is calculated and released to act on the projectile. This air induces an additional pressure force onto the rear of the projectile as it travels down the barrel. This helps to increase the velocity of the projectile which increases accuracy and flattens the path of travel. The release of pressure through the ports are automatic and mechanically activated through recoil action of the slide upon firing. The location of the valves within the chamber are determined by design constraints and are in no way limited to the areas specifically depicted in the Figures.

An added benefit of the electronically controlled enhancement is that a number of firearms may use ammunition having variable grain sizes or in general different sized ammunitions. These may behave differently when shot through particular firearms. Such differences may affect the desired timing of discharge through the valves. The electrically controlled artillery enhancement of the present application is configured to compensate for differences. A user may input data into the electronic device and calibrate for particular projectiles all through the same firearm in use.

Users can achieve at least a trio of benefits from this concept when applying progressive modifications such as a reengineered ported firing pin/primer pin, with a fitted gas recharging/reenergizing supply, having specifications engineered to provide correct reenergizing pressurization, types of gases, the volume of gases and, the correct accompanying connecting materials attached to the injecting firing pin, ported firing pin and/or both functioning simultaneously to/for increasing bore and or barrel pressures on command when needed or when wanted. (The advantages of these functions named/described above) are: (A) Achieving the ambition to shoot special need firearms of any caliber extremely long distances when needed or desired; (B) being accomplished in/within shooting large caliber firearms with extreme velocities without destroying the shell casing/brass, the weapon, and certain projectiles; and (C) to maintain outstanding to exceptional accuracy while accomplishing A&B.

Figure 8:
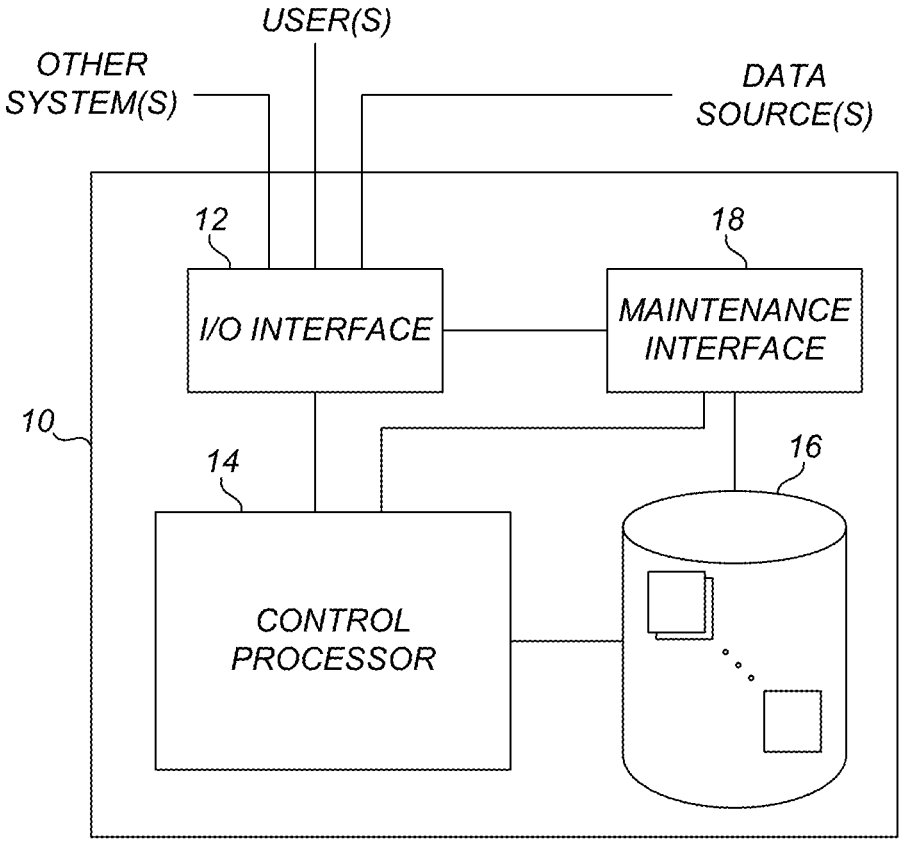
FIG. 8 is a schematic of an electronic control system used with the firearm of FIGS. 1-7.

Referring now also to FIG. 8 in the drawings, a schematic of an electronic control system used in the electronic velocity enhancement assembly and firearm is illustrated. The control system 10 is configured to regulate the discharge of pressurized gas from a reservoir to assist in propelling the projectile through the chamber. System 10 also is configured to monitor and detect the location of the projectile in the chamber via one or more sensors. System 10 calculates the precise timing to release the pressurized gas and sends command data to the one or more control valves to open at the appropriate time.

System 10 includes an input/output (I/O) interface 12, a control processor 14, a database 16, and a maintenance interface 18. Alternative embodiments can combine or distribute the input/output (I/O) interface 12, control processor 14, database 16, and maintenance interface 18 as desired. Embodiments of system 10 can include one or more computers that include one or more processors and memories configured for performing tasks described herein below. This can include, for example, a computer having a central processing unit (CPU) and non-volatile memory that stores software instructions for instructing the CPU to perform at least some of the tasks described herein. This can also include, for example, two or more computers that are in communication via a computer network, where one or more of the computers includes a CPU and non-volatile memory, and one or more of the computer's non-volatile memory stores software instructions for instructing any of the CPU(s) to perform any of the tasks described herein. Thus, while the exemplary embodiment is described in terms of a discrete machine, it should be appreciated that this description is non-limiting, and that the present description applies equally to numerous other arrangements involving one or more machines performing tasks distributed in any way among the one or more machines. It should also be appreciated that such machines need not be dedicated to performing tasks described herein, but instead can be multi-purpose machines, for example computer workstations, that are suitable for also performing other tasks. Furthermore, the computers may use transitory and non-transitory forms of computer-readable media. Non-transitory computer-readable media is to be interpreted to comprise all computer-readable media, with the sole exception of being a transitory, propagating signal.

The I/O interface 12 provides a communication link between external users, systems, and data sources and components of system 10. The I/O interface 12 can be configured for allowing one or more users to input information to system 10 via any known input device. Examples can include a keyboard, mouse, touch screen, microphone, and/or any other desired input device like the sensors and control valves. The I/O interface 12 can be configured for allowing one or more users to receive information output from system 10 via any known output device. Examples can include a display monitor, a printer, a speaker, and/or any other desired output device. The I/O interface 12 can be configured for allowing other systems to communicate system 10. For example, the I/O interface 12 can allow one or more remote computer(s) to access information, input information, and/or remotely instruct system 10 to perform one or more of the tasks described herein. The I/O interface 12 can be configured for allowing communication with one or more remote data sources. For example, the I/O interface 12 can allow one or more remote data source(s) to access information, input information, and/or remotely instruct system 10 to perform one or more of the tasks described herein.

The database 16 provides persistent data storage with system 10. While the term "database" is primarily used, a memory or other suitable data storage arrangement may provide the functionality of the database 16. In alternative embodiments, the database 16 can be integral to or separate from system 10 and can operate on one or more computers. The database 16 preferably provides non-volatile data storage for any information suitable to support the operation of system 10.

The maintenance interface 18 is configured to allow users to maintain desired operation of system 10. In some embodiments, the maintenance interface 18 can be configured to allow for reviewing and/or revising the data stored in the database 16 and/or performing any suitable administrative tasks commonly associated with database management. This can include, for example, updating database management software, revising security settings, and/or performing data backup operations. In some embodiments, the maintenance interface 18 can be configured to allow for maintenance of the control processor 14 and/or the I/O interface 12. This can include, for example, software updates and/or administrative tasks such as security management and/or adjustment of certain tolerance settings. The control processor 14 is configured for monitoring the location of the projectile in the chamber, processing or calculating the appropriate timing for release of the pressurized gas in the firing pin/primer or control valves, opening and closing the control valves, and so forth.

The current application has many advantages over the prior art as mentioned herein, such as (1) Deploying artillery firepower from 30-35% further distance of areas/radius; (2) Firing with greater accuracy; and (3) A broader scope of versatility within one firearm/weapons' safety and less risk for the boots on the ground.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application.

Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A firearm propulsion system for releasing a projectile from a cartridge casing and from a firearm, comprising:

a chamber and a firing pin, the firing pin configured to initiate a primer of the cartridge casing;

a ported primer in communication with the firing pin, the ported primer permitting the passage of pressurized gas through the firing pin and then through the casing after firing of the projectile;

a barrel in communication with the chamber;

a supply port passing through at least one of the barrel and the chamber;

a control valve in communication with the supply port and the ported primer, the control valve configured to regulate the passage of pressurized gas into the at least one of the barrel and the chamber and through the casing; and a sensor in the at least one of the barrel and the chamber, the sensor configured to detect the location of the projectile passing through the at least one of the barrel and chamber after firing the firearm.

2. The system of claim 1, wherein the sensor is before the barrel.

3. The system of claim 1, wherein the control valve is located in the firearm.

4. The system of claim 1, further comprising: a control system coupled to the sensor and the control valve, the control system configured to receive the location of the projectile from the sensor.

5. The system of claim 1, further comprising: a control system coupled to the control valve, the control system configured to selectively release pressurized gas through the supply port after firing the firearm.

6. The system of claim 5, wherein the control system is configured to communicate with the sensor to determine the location of the projectile.

7. The system of claim 6, wherein the control system is configured to operate the control valve based upon the location of the projectile.

8. The system of claim 1, wherein the release of pressurized gas through the ported primer is regulated by the control system.

* * * * *